137-13 SR
6/10/80 XR 4,206,610

United States Patent [19]
Santhanam
[11] 4,206,610
[45] Jun. 10, 1980

[54] METHOD AND APPARATUS FOR TRANSPORTING COAL AS A COAL/LIQUID CARBON DIOXIDE SLURRY

[75] Inventor: Chakra J. Santhanam, Lexington, Mass.

[73] Assignee: Arthur D. Little, Inc., Cambridge, Mass.

[21] Appl. No.: 896,167

[22] Filed: Apr. 14, 1978

[51] Int. Cl.² ..... F17C 7/02
[52] U.S. Cl. ..... 62/55; 137/13; 406/154; 406/197; 423/437
[58] Field of Search ..... 62/46, 47, 48, 55; 423/437; 137/13; 302/66; 48/197 R; 406/197, 154

[56] References Cited

U.S. PATENT DOCUMENTS

| | | | |
|---|---|---|---|
| 2,543,170 | 2/1951 | Hill | 62/55 |
| 3,719,397 | 3/1973 | Wasp | 302/66 |
| 3,730,201 | 5/1973 | Lefever | 62/55 |
| 3,810,365 | 5/1974 | Hampton | 62/48 |
| 3,870,063 | 3/1975 | Hayward | 62/55 |
| 3,933,001 | 1/1976 | Muska | 62/47 |
| 3,976,442 | 8/1976 | Paull et al. | 48/197 R |
| 3,976,443 | 8/1976 | Paull et al. | 48/197 R |

*Primary Examiner*—Ronald C. Capossela
*Attorney, Agent, or Firm*—Bessie A. Lepper

[57] ABSTRACT

Method and apparatus for transporting coal in finely divided form in a coal/liquid slurry. Liquid carbon dioxide, which can be formed by burning coal at the coal source point and liquefying the resulting gaseous carbon dioxide, serves as the slurry liquid. The slurry is pumped through a slurry pipeline to the coal use point under conditions of temperature and pressure to maintain the carbon dioxide in liquefied form. Subsequent to deslurrying, the coal-free carbon dioxide can be liquefied and returned through a liquid pipeline to the coal source point for reuse. The use of liquid carbon dioxide as a slurry medium is also applicable to transporting other finely divided solids such as ores and the like.

41 Claims, 4 Drawing Figures

METHOD AND APPARATUS FOR TRANSPORTING COAL AS A COAL/LIQUID CARBON DIOXIDE SLURRY

This invention relates to the transportation of finely divided solids and more particularly to a method and apparatus for transporting coal in a slurry form.

The recent emphasis on the use of coal as a primary energy source has indicated the need for a full evaluation of all of the known techniques for coal transportation and for a consideration of new and improved methods and apparatus for this purpose.

Overland transportation has been used to move by far the greatest bulk of the coal from the mines to the points of use. Thus, for example, over the decade from 1963-1972 about 71% of the bituminous coal mined in the United States was moved by rail; and about 12% each by truck and barge. The remainder has been used at the mine to generate electricity for transmission over power lines. Environmental objections have, however, been raised to the construction of large power plants near some mines; and in some instances transmission of electric power over long distances is wasteful of energy.

More recently, it has been proposed to transport coal by pumping it as a water slurry through pipelines. A few of these pipelines have been built and operated; and additional pipelines are planned or under construction. From the information available, all of these pipelines use or will use water to form the slurry, although methanol has been proposed as an alternative for water.

The transport of coal by pumping a coal/water slurry through a pipeline has certain advantages over transporting by rail. Once the pipelines are laid and the system installed, operational costs are relatively low. At present the cost of pipeline transport is competitive with rail transport; and it is expected that pipeline transport will exhibit material economic advantages in the future. It is anticipated that some of these pipeline costs will not increase as rapidly as rail costs since pipeline transport costs have a smaller labor component than rail costs. Furthermore, in terms of energy consumed for transport as a percentage of energy transported, moving coal as a coal/water slurry through a pipeline offers promise. It may also be pointed out that pipeline transport of a coal/water slurry should be reliable and environmentally acceptable provided no serious problems are encountered in disposing of the water at the coal use point.

There are, however, serious inherent disadvantages in the transport of coal as a coal/water slurry. One of these disadvantages lies in the necessity to provide large amounts of water to form the slurry. From the presently known geographical distribution of coal it is possible to predict with considerable confidence that the major movement of coal will be from the mines in the Western States to the Middle West and South. This, in turn, means that the water to form the slurry must be furnished from those states wherein water supplies are most critical. It is believed, therefore, that many coal-producing Western States will be reluctant to provide water for this purpose.

Another disadvantage inherent in the use of coal/water slurries lies in the fact that it is very difficult to separate the coal from the water at the point of coal use. The finely divided coal in the slurry tends to agglomerate, making the separation of the solid coal from liquid water even more difficult. For all practical purposes, such coal/water slurries cannot be dewatered below about 30 to 35% water, even by centrifuging. Such a water content is about 15% above the intrinsic water content of the coal. This, in turn, materially decreases the overall Btu content of the coal since an appreciable part of its heating value must be expended in the vaporization of large amounts of water. Moreover, excess water in the coal may require downgrading of the combustion equipment using the coal. Finally, if the water should be returned to the coal source point, a considerable amount of capital cost and energy would be required.

Therefore, although the transport of coal as a coal/water slurry offers a number of advantages, these advantages are partially offset by several major disadvantages, at least one of which—water supply—may prohibit this method of coal transport from enjoying any widespread or large scale acceptance. This, in turn, indicates the need for a coal transport method which can retain the advantages associated with pumping a coal/liquid slurry through a pipeline while at the same time being free from those major disadvantages inherent in the use of a coal/water slurry.

It is, of course, conceivable that it may also become desirable to transport other finely divided solids, e.g., iron ore, as a liquid slurry. The process and apparatus of this invention are applicable to such solids which are inert to liquid carbon dioxide. However, for convenience in describing the invention, the solid material will be assumed to be coal.

It is therefore a primary object of this invention to provide an improved method for transporting finely divided solids and particularly coal, the method being based upon pumping a coal/liquid slurry through a pipeline. It is another object of this invention to provide a method of the character described which does not require the use of water with the resultant possible dislocation of water distribution and with the resultant need to use the transported coal with an excessive water content. It is an additional object to provide a method of transporting coal as a coal/liquid slurry which requires less power to pump, which minimizes coal particle agglomeration, and which employs more economical and efficient techniques for separating the coal from the slurrying medium than in the case of a coal/water slurry. This invention has as still another object the providing of a coal transport method which is low in energy consumption, economical to operate, reliable in all weather conditions and environmentally acceptable.

It is another primary object of this invention to provide improved apparatus for the transport of coal as a coal/liquid slurry. A further object of this invention is to provide apparatus of the character described which can readily be integrated into and combined with mining operations at the coal source and combustion equipment at the point of coal utilization. It is yet another object to providing such apparatus which requires only a minimum number of skilled operational personnel between the points of coal source and coal delivery.

Other objects of the invention will in part be obvious and will in part be apparent hereinafter.

According to one aspect of this invention there is provided a method for transporting coal, comprising suspending coal in finely divided form in liquid carbon dioxide to form a coal/liquid carbon dioxide slurry and pumping the slurry from a coal source point to a coal use point through a pipeline under conditions of temperature and pressure to maintain essentially all of the carbon dioxide in liquid form. According to a preferred embodiment of this method aspect of the invention, the carbon dioxide is maintained at a temperature between about 0° and 30° C. and at a pressure between about 25 and about 150 atmospheres.

According to another aspect of this invention there is provided apparatus for transporting coal in finely divided form from a coal source point to a coal use point, comprising in combination slurry forming means at a coal source point to form a coal/liquid carbon dioxide slurry; deslurrying means at a coal use point to deslurry the coal/liquid carbon dioxide slurry to provide coal for combustion and essentially coal-free carbon dioxide; and slurry pipeline means connecting the slurry forming means and the deslurrying means arranged to carry the coal/liquid carbon dioxide slurry under conditions of temperature and pressure to maintain essentially all of the carbon dioxide in liquid form.

In a preferred embodiment of the apparatus of this invention, there are also provided means to burn coal at the coal source point and to liquefy the resulting carbon dioxide formed to provide the required liquid carbon dioxide; means associated with the deslurrying means to liquefy the coal-free carbon dioxide; and liquid pipeline means to return the liquefied carbon dioxide to the coal source point, whereby the production of carbon dioxide at the coal source point is limited to the production of makeup liquefied carbon dioxide.

The invention accordingly comprises the several steps and the relation of one or more of such steps with respect to each of the others, and the apparatus embodying features of construction, combinations of elements and arrangements of parts which are adapted to effect such steps, all as exemplified in the following detailed disclosure, and the scope of the invention will be indicated in the claims.

For a fuller understanding of the nature and objects of the invention, reference should be had to the following detailed description taken in connection with the accompanying drawings in which FIG. 1 is a flow diagram of the method of this invention;

Figure 1:
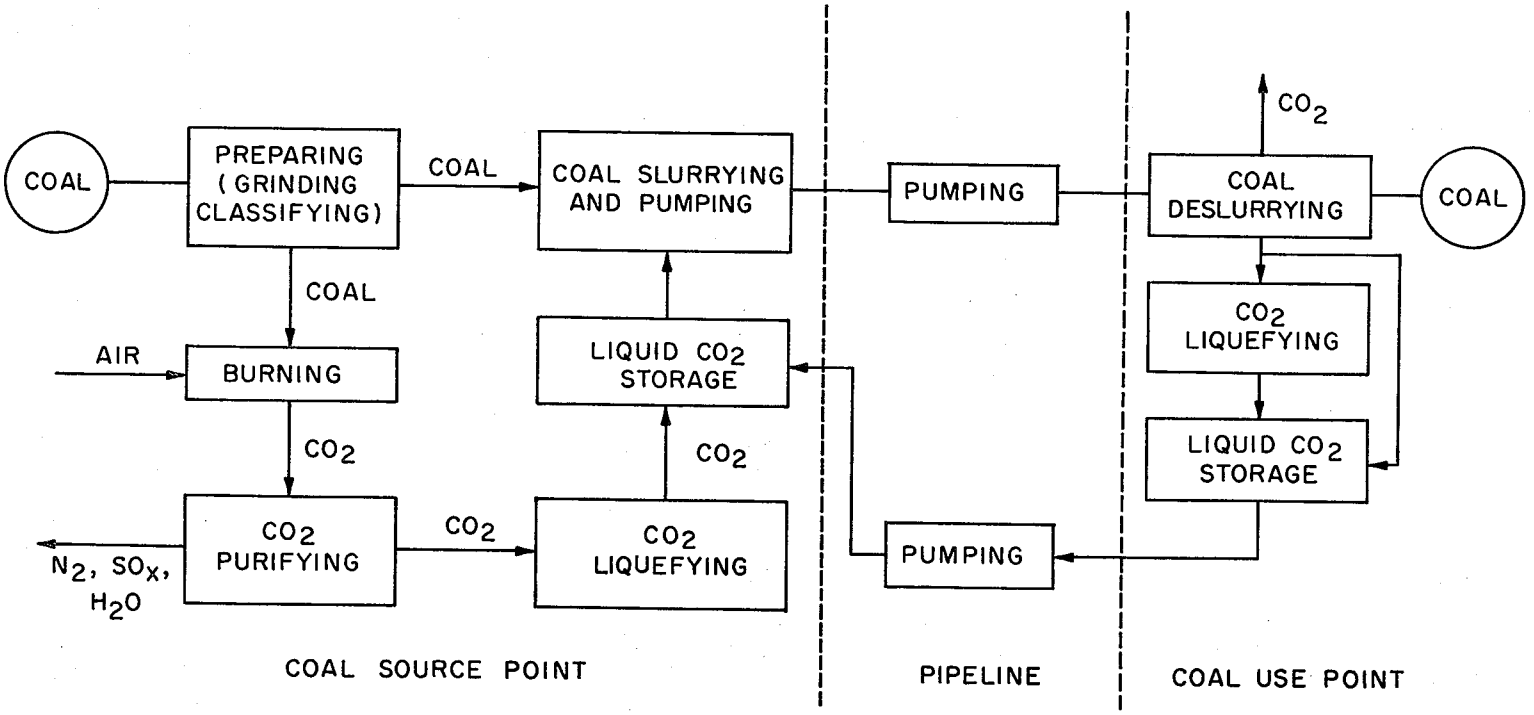

FIG. 1 is a flow diagram of the method and a schematic of the apparatus of this invention. The as-mined coal is prepared for slurrying by reducing it to the desired particle size distribution, e.g., by grinding or other well-know technique and, if necessary, classifying with respect to particle size. Such preparation and handling follow standard procedures and may be carried out in conventional, commercially available equipment. In order to form a suitable slurry, essentially all of the coal to be transported should be sized to pass a U.S. 50-mesh screen, i.e., the particles should be no greater than about 300 microns in diameter. A minor percentage (e.g., up to about 40% by weight) of the coal may be sized fine enough to pass a 325-mesh screen (40 microns in diameter). It is, however, preferable to use coal having a controlled particle size distribution, this distribution being optimized for the viscosity of the liquid carbon dioxide being used as detailed below. The size distribution of the coal particles should preferably be that which gives rise to a stable slurry, i.e., a slurry from which the coal particles will not settle out to any appreciable degree. This allows a pipeline containing slurry to be shut down and have the flow therethrough restarted by only restarting the pump.

A small fraction (e.g., less than about 1% by weight) of the coal is burned in any suitable, conventional burner in an excess of air to form the carbon dioxide to be used in forming the slurry. The resulting carbon dioxide-containing exhaust gases are treated to remove nitrogen, nitrogen oxides, sulfur oxides, moisture and ash to produce an essentially pure carbon dioxide gas. Gas treating processes and apparatus for $SO_x$ removal and $CO_2$ recovery are well known. For example, the exhaust gases, after ash removal, may be scrubbed by conventional means with an alkali metal hydroxide-containing liquid to react with the $SO_x$; and hot $K_2CO_3$ or an amine may be used to recover the $CO_2$ from the remaining gases.

The resulting purified carbon dioxide is then liquefied by pressurizing it and adjusting the temperature to the desired level. Pressurizing may be accomplished by compressing in any suitable compressor. The liquefied carbon dioxide is then transferred to a liquid carbon dioxide storage vessel from which it is taken to form the coal/liquid carbon dioxide slurry. Although the pressure of the liquid carbon dioxide in the slurry as it is pumped through the pipeline will range between about 25 and about 150 atmospheres and the temperature will range between about 0 and 30° C., liquefaction and storage of the carbon dioxide need not be carried out within this range since adjustments in pressure and temperature may be made as the liquid carbon dioxide is conducted from storage to the slurrying equipment. Thus, it may be desirable to store the liquid carbon dioxide at a pressure and temperature somewhat above the level desired for the slurry to allow for pressure drop in slurry formation and a concomitant decrease in temperature through expansion.

Figure 2:
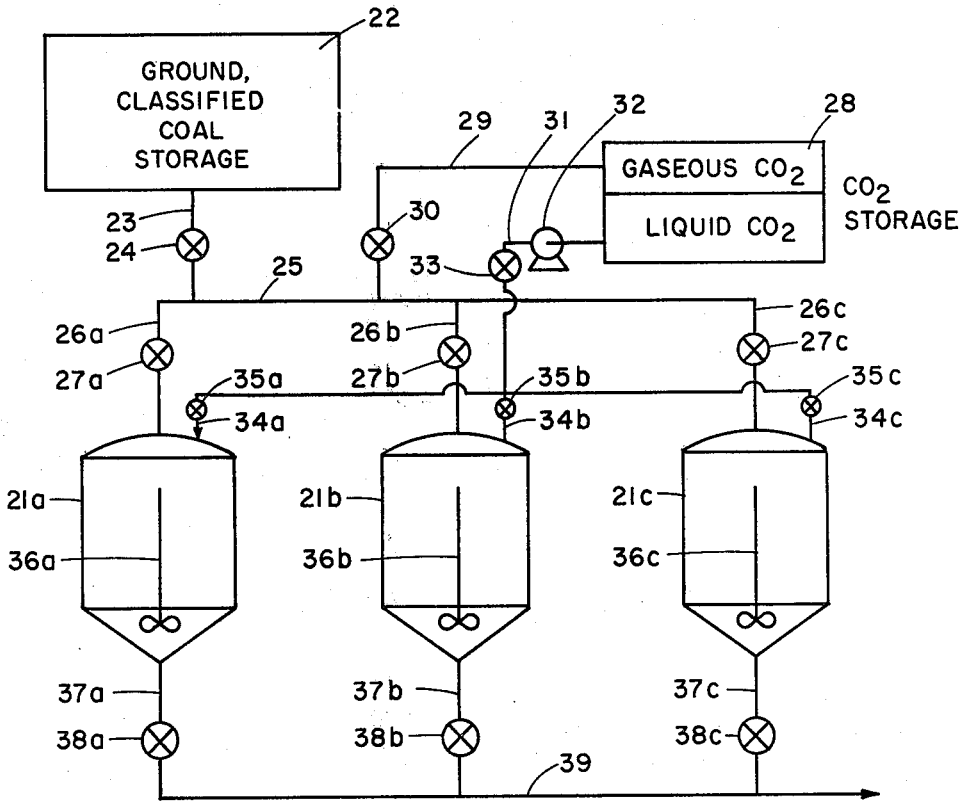
FIG. 2 is a schematic diagram of one embodiment of the apparatus and method step for forming the coal/liquid carbon dioxide slurry based on slurrying successive batches of coal.

Any one of several method and apparatus embodiments may be used for forming the pressurized coal/liquid carbon dioxide slurry. One embodiment of such method and apparatus, based on slurrying successive batches of coal is illustrated in FIG. 2. As will be seen in FIG. 2, there are provided a number of pressurizable coal bins 21*a*, 21*b*, and 21*c* which are connected to a coal storage bin 22 through a coal conduit 23 having a valve 24 and communicating with a main conduit 25. Branch conduits 26*a*, 26*b*, and 26*c*, having valves 27*a*, 27*b*, and 27*c*, respectively, lead from main conduit 25 to the pressurizable coal bins. A liquid carbon dioxide storage vessel 28 provides both gaseous carbon dioxide through line 29 and valve 30, and liquid carbon dioxide, through line 31, pump 32 and valve 33, to the pressurizable coal bins, by way of branch conduits 34*a*, 34*b* and 34*c* having valves 35*a*, 35*b* and 35*c*, respectively. Each of the coal bins is equipped with a suitable stirring means 36*a*, 36*b* or 36*c* and each has a slurry discharge line, 37*a*, 37*b* or 37*c*, controlled by valve 38*a*, 38*b* or 38*c*, and communicating with main slurry pipeline 39.

The operation of the apparatus of FIG. 2 in forming the required coal/liquid carbon dioxide may be illustrated in the following example in which it is assumed that pressurizable coal bin 21*a* is to be used. To begin, all valves except 24 and 27*a* are closed and coal is pumped or fed by gravity into bin 21*a* to a predetermined level. Valve 24 is then closed and valve 30 is opened to allow high-pressure gaseous carbon dioxide to flow into bin 21*a* and pressurize it to the desired level. Subsequently, valve 30 is closed and valve 34*a* is opened to permit liquid carbon dioxide to be pumped into bin 21*a* and to be slurried, by stirring, with the pressurized coal. After a sufficient quantity of liquid carbon dioxide has been pumped into bin 21*a*, valves 34*a* and 27*a* are closed and valve 38*a* is opened to discharge the coal/liquid carbon dioxide slurry into main slurry pipeline 39 for transport through the pipeline to the remote point of deslurrying and use. By using each pressurizable coal bin in turn in the manner described, it is possible to provide an essentially continuous supply of slurried coal to pipeline 39. It is, or course, within the scope of this invention to use any number of pressurizable coal bins in this batch process embodiment.

Figure 3:
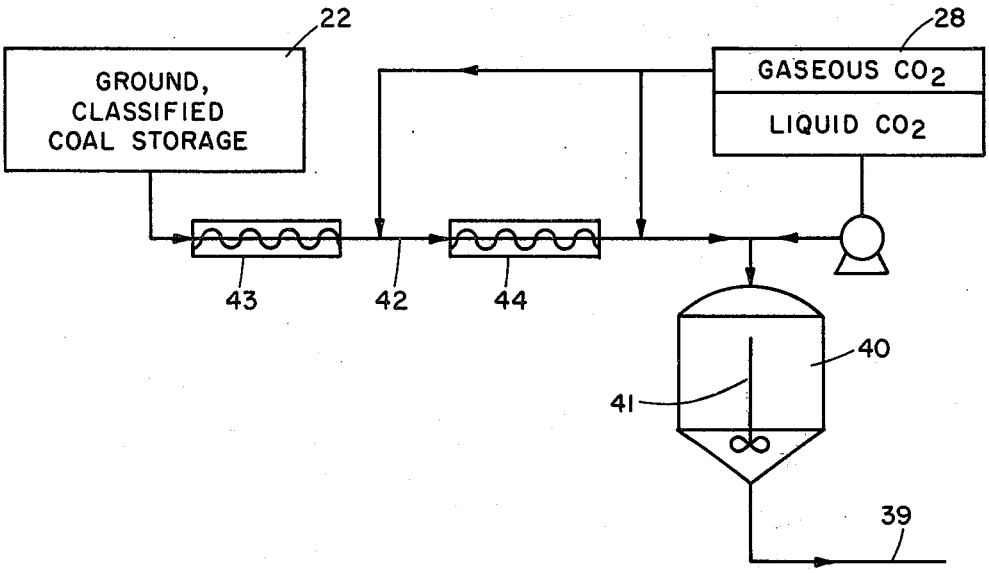
FIG. 3 is a schematic diagram of another embodiment of the apparatus and method step for forming the coal/liquid carbon dioxide slurry based on a continual slurrying of the coal.

Another embodiment of the slurrying method and apparatus is illustrated in FIG. 3 and is designed to continually form the required pressurized slurry using a single pressurizable coal bin 40 equipped with stirring means 41. In coal conduit 42 connecting coal storage 22 and bin 40 are two (or more) screw conveyors 43 and 44 of a type which permits a pressure drop to be maintained thereacross. These screw conveyors are pressure staged in order to provide coal under the desired pressure to bin 40, e.g., at about 60–65 atmospheres. Pressurizing is conveniently carried out by using pressurized, boiled-off gaseous carbon dioxide from carbon dioxide storage vessel 28. The resulting pressurized coal and the pressurized liquid carbon dioxide are introduced simultaneously into bin 40 for mixing and discharge into main slurry pipeline 39.

The pressurized coal/liquid carbon slurry pumped through the main slurry pipeline to the point of deslurrying should be maintained at a temperature between about 0° C. and about 30° C. and under a pressure between about 25 atmospheres and about 150 atmospheres. It will be appreciated that within these temperature and pressure ranges, the carbon dioxide is a liquid. Under these conditions there is no appreciable extraction by the liquid carbon dioxide of hydrocarbons, sulfur or other noncarbonaceous constiuents from the coal. Nor is any appreciable quantity of $H_2CO_3$ formed which might present a chemical corrosion problem.

Moreover, the finely divided coal does not agglomerate in liquid carbon dioxide, a fact which is in direct contrast to the situation which obtains in the case of coal/water slurries. Rather, the finely divided coal is easily dispersed in liquid carbon dioxide and remains dispersed during transport. The viscosity of a coal/liquid carbon dioxide slurry at about 12.5° C. is approximately one-tenth to one-thirtieth of that of coal/water slurry at ambient temperature and at the same solids concentration, a fact which materially decreases the friction forces along the slurry pipeline. This, in turn, decreases the pressure drop and hence the power required to pump the slurry. Finally, coal can be loaded to a much higher weight percent level in liquid carbon dioxide than in water. For example, it can be loaded up to about 50% to about 55% percent by weight in water (i.e., one hundred pounds of slurry contains from about 50 to 55 pounds of finely divided coal); whereas this figure can be as high as about 75 to about 80 in pounds of coal per 100 pounds of a coal/liquid carbon dioxide slurry. Generally, a loading range of between about 60% and 80% by weight will be preferred in the practice of this invention.

The main slurry pipelines will preferably be buried underground below the frostline to minimize problems of icing and/or relatively large variations in temperature with changing seasons. At such depths, the average ambient temperature is normally between about 10° C. and about 16° C., a temperature range essentially midway between the specified broad range of between about 0° C. and 30° C. It is, of course, possible to insulate the pipelines to maintain the slurry temperature at a level which is not in equilibrium with that of the ground in which it is laid.

The velocity of the coal/liquid carbon dioxide slurry as it is pumped through the pipeline preferably ranges between about 1 and about 6 feet per second, the optimum velocity chosen depending upon such factors as coal composition, coal size distribution, ambient temperature, loading level, and the like.

It will be necessary for those pipelines extending over relatively long distances, e.g., over about 100 miles to have one or more intermediate booster pumping stations associated with them to maintain the desired pumping pressure and slurry velocity. Such pumping stations may also be used to provide any necessary adjustments in temperature, e.g., make-up refrigeration or added heat to the slurry through out-of-contact heat transfer with a suitable refrigeration system, e.g., liquid nitrogen, or with a suitable heat source such as combustion gases.

Once the coal/liquid carbon dioxide slurry reaches the end of the pipeline at the point of coal use or coal storage, it is necessary to separate the carbon dioxide from the coal by deslurrying it. In deslurrying it is preferable that no appreciable amount of solid carbon dioxide is formed since this solid material must subsequently be separated from the solid coal and an appreciable percentage of it may be lost to the system. Such losses must be made up by burning additional coal at the mine. Thus, although it is possible to remove the carbon dioxide by merely releasing the pressure on the coal/liquid carbon dioxide slurry, this is not a preferable technique for deslurrying since it results in the formation of solid carbon dioxide with its attendant disadvantages in separation.

Since the slurry is a solid-liquid mixture, it is possible to use such conventional dewatering equipment as solid bowl centrifuges or liquid-solid cyclone separators operating under pressure to deslurry the coal. This method has the advantage of requiring a relatively small amount of energy to reliquefy any vaporized carbon dioxide before recycling.

Figure 4:
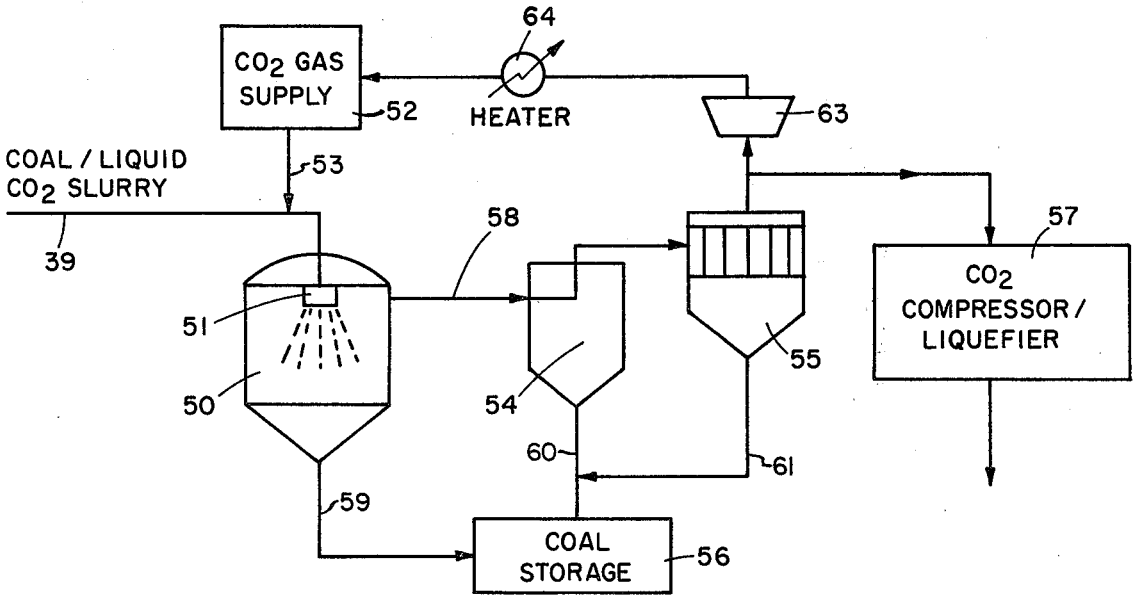
FIG. 4 is a schematic diagram of a preferred embodiment of the apparatus and method step for deslurrying the coal/liquid carbon dioxide slurry.

FIG. 4 diagrams a preferred method and apparatus for accomplishing the step of deslurrying. The apparatus will be seen to comprise a pressurized spray tower 50 having one or more spray heads 51, a supply of gaseous carbon dioxide 52 at a predetermined temperature in fluid communication through gas line 53 with the slurry pipeline 39, a cyclone separator 54, a bag filter (optional) 55, an ambient pressure/temperature coal storage bin 56 and a carbon dioxide liquefier 57. A gas line 58 connects tower 50, cyclone separator 54, bag filter 55 and liquefier 57. A coal discharge line 59 connects tower 50 to coal storage 56 and solids discharge lines 60 and 61 provide means, if desired, for taking the remaining solids separated from the carbon dioxide in the cyclone separator 54 and filter 55 to coal storage 56.

In operation, the liquid carbon dioxide of the slurry is adiabatically expanded to reduce the pressure to that level at which essentially all of the carbon dioxide will vaporize out of the slurry. Sufficient gaseous carbon dioxide at an elevated temperature is added to the slurry from carbon dioxide gas supply 52 prior to the introduction of the slurry into spray tower 50 to provide the heat lost in the expansion of the slurry, thus preventing solidification of any appreciable amount of the carbon dioxide. Any solids remaining in the carbon dioxide withdrawn through line 58 are removed in the pressurized cyclone separator (of which there may be more than one) and in the bag filter if included. These solids may be returned to the coal if desired. A portion of the gaseous carbon dioxide from filter 55 is recycled through expander 63 and heater 64 to carbon dioxide gas supply 52; and the remainder of the gaseous carbon dioxide from filter 55 is compressed and liquefied in compressor/liquefier 57.

An example of the deslurrying step as performed in the apparatus of FIG. 4 may be given. In this example it is assumed that the external heat input for a 1190-ton/-hour coal transport system is about 40.5 MM Btu/hour; carbon dioxide is obtained as recycle as shown in FIG. 4 and heated between about 38° C. and 93° C. by steam. A coal/liquid carbon dioxide slurry at 5° C. and under 40–45 atmospheres pressure is mixed with recycle carbon dioxide gas (heated by steam between 38° C. and 93° C.) at 40° to 80° C. and expanded to 5° C. and 38 atmospheres pressure. The resulting carbon dioxide gas finally reaching liquefier 57 is at 5° C. and 38 atmospheres pressure. Part of this carbon dioxide is recycled, after heating, to the deslurrying equipment.

As will be seen in FIG. 1, the carbon dioxide recovered from deslurrying is, if necessary, returned, after liquefaction, to the coal source point through a liquid carbon dioxide pipeline. As in the case of the slurry pipeline, it may be necessary to use one or more pumping stations in conjunction with this liquid pipeline which is also preferably buried in the ground below the frost line and located parallel to the slurry pipeline so that any one pumping station and refrigeration means could be used in conjunction with both pipelines. The diameters of the pipelines will be determined by the mass flow through them, the slurry pipeline being larger than the liquid pipeline.

The liquid carbon dioxide returned to the coal source point is sent to the liquid carbon dioxide storage for use in forming the slurry. Once the system is started up, only sufficient coal is burned to supply makeup liquid carbon dioxide.

The following example further illustrates the process of this invention which is not, of course, limited to the exemplary conditions and parameters set forth. It is assumed that ten million short tons of coal is to be transported per year over a distance of one thousand miles and that a year constitutes 8,400 hours' operation. All figures are given in short tons/hour. 1195.2 tons of coal is provided from the mine and ground; and of this amount, 4.7 tons is burned to form makeup liquid carbon dioxide. 316.8 tons of liquid carbon dioxide at between 10° C. and 16° C. and at 74.8 atmospheres pressure is slurried with the coal and introduced into the slurry pipeline to provide slurry having a coal level of about 79 weight percent and a mass flow rate of 1507.3 tons per hour. The slurry pipeline used has an inside diameter of 22 inches (56 cms) and 16 pumping stations, each providing up to about 1600 HP pumping power, are essentially equally spaced along the pipeline. Refrigeration to the slurry is provided if required at the pumping stations.

Subsequent to the deslurrying of the coal in apparatus such as that shown in FIG. 4., and after liquefaction, some 304 tons of liquid carbon dioxide are available for returning to the coal source point through the liquid carbon dioxide pipeline which is 12 inches (about 30.5 cm) in diameter. Each pumping station has up to 1000 HP pumping power to boost the pressure of the liquid; and any required additional refrigeration is supplied at all or selected ones of the pumping stations.

It will be apparent from the above detailed description of this invention that there are provided an improved method and an improved apparatus for the transport of finely divided coal in slurry form. The use of liquid carbon dioxide in place of water to form the slurry eliminates the need to transfer much needed water from areas short of water; it permits higher solids loading; requires less energy to pump and provides for more efficient separation of the coal from the slurry at the point of delivery. Moreover, the carbon dioxide is produced by burning a small amount of the coal, giving rise to an essentially self-contained system which achieves a ratio of energy consumed to energy transported which is favorably competitive with all other coal transport systems. Finally, the process and apparatus of this invention are capital intensive, and provide a system for the transport of coal which is unaffected by weather conditions and environmentally acceptable.

It will thus be seen that the objects set forth above, among those made apparent from the preceding description, are efficiently attained and, since certain changes may be made in carrying out the above process and in the constructions set forth without departing from the scope of the invention, it is intended that all matter contained in the above description or shown in the accompanying drawings shall be interpreted as illustrative and not in a limiting sense.

I claim:

1. A method for transporting coal from a coal source point to a coal use point, comprising the steps of (a) slurrying coal in finely divided form with liquid carbon dioxide to form a stable coal/liquid carbon dioxide slurry at said coal source point;

(b) pumping said slurry through a pipeline to said coal use point; and (c) deslurrying said coal/liquid carbon dioxide slurry at said coal use point to separate said coal and said liquid carbon dioxide and to provide said coal in condition for burning and coal-free carbon dioxide, said deslurrying comprising adibatically expanding said slurry to reduce the pressure to that level at which essentially all of said carbon dioxide is vaporized out of said slurry; and prior to said expanding, introducing into said slurry sufficient heat to provide that lost in said expanding, whereby no appreciable amount of said carbon dioxide is solidified.

2. A method in accordance with claim 1 wherein said step of introducing heat into said slurry comprises adding thereto gaseous carbon dioxide at an elevated temperature.

3. A method in accordance with claim 1 wherein said coal is sized to pass a 50-mesh screen.

4. A method in accordance with claim 3 wherein a minor weight portion of said coal is sized to pass a 325-mesh screen and the size distribution of said coal is essentially optimized for the viscosity of said liquid carbon dioxide to obtain stability of said slurry.

5. A method in accordance with claim 1 wherein the weight loading of said coal in said slurry is up to 80%.

6. A method in accordance with claim 1 wherein the temperature of said slurry during pumping ranges between about 0° C. and about 30° C.

7. A method in accordance with claim 1 wherein the pressure of said slurry during pumping ranges between about 25 atmospheres and about 150 atmospheres.

8. A method in accordance with claim 1 wherein said pumping of said slurry imparts a velocity to said coal/-liquid carbon dioxide in said pipeline of between about 1 and about 6 feet per second.

9. A method in accordance with claim 1 including the step of boosting the pressure of said slurry at selected points along said pipeline.

10. A method in accordance with claim 1 including the step of adjusting the temperature of said slurry at selected points along said pipeline.

11. A method in accordance with claim 1 wherein said step of slurrying said coal comprises pressurizing said finely divided coal with gaseous carbon dioxide and then mixing the resulting pressurized coal with liquid carbon dioxide.

12. A method in accordance with claim 1 including the step of returning at leas a portion of said coal-free carbon dioxide from said coal use point to said coal source point.

13. A method in accordance with claim 12 wherein said step of returning said coal-free carbon dioxide to said coal source point comprises liquefying said coal-free carbon dioxide at said coal use point and pumping it through a separate liquid pipeline back to said coal source point for reuse in forming said slurry.

14. A method in accordance with claim 13 including the step of boosting the pressure of said liquid carbon dioxide at selected points along said liquid pipeline.

15. A method in accordance with claim 13 including the step of adjusting the temperature of said liquid carbon dioxide at selected points along said liquid pipeline.

16. A method in accordance with claim 1 including the step of forming said liquid carbon dioxide at said coal source point by burning coal in an excess of air to form combustion gases to containing carbon dioxide, purifying said combustion gases o provide essentially pure carbon dioxide gas, and liquefying said carbon dioxide gas.

17. A method for transporting coal from a coal source point to a coal use point, comprising the steps of (a) forming liquid carbon dioxide at said coal source point by burning coal in an excess of air to form combustion gases containing carbon dioxide, purifying said combustion gases to provide essentially pure carbon dioxide gas, and liquefying said carbon dioxide gas;

(b) slurrying coal in finely divided form with said liquid carbon dioxide to form a coal/liquid carbon dioxide slurry at said coal source point;

(c) pumping said slurry through a pipeline to said coal use point; and (d) deslurrying said coal/liquid carbon dioxide slurry at said coal use point to separate said coal and said liquid carbon dioxide and to provide said coal in condition for burning and coal-free carbon dioxide.

18. A method in accordance with claim 17 wherein said koal is sized to pass a 50-mesh screen.

19. A method in accordance with claim 18 wherein a minor weight portion of said coal is sized to pass a 325-mesh screen and the size distribution of said coal is essentially optimized for the viscosity of said liquid carbon dioxide in said slurry.

20. A method in accordance with claim 17 wherein the weight loading of said coal in said slurry is up to 80%.

21. A method in accordance with claim 17 wherein the temperature of said slurry during pumping ranges between about 0° C. and about 30° C.

22. A method in accordance with claim 17 wherein the pressure of said slurry during pumping ranges between about 25 atmospheres and about 150 atmospheres.

23. A method in accordance with claim 17 wherein said pumping of said slurry imparts a velocity of said coal/liquid carbon dioxide in said pipeline of between about 1 and about 6 feet per second.

24. A method in accordance with claim 17 including the step of bcosting the pressure of said slurry at selected points along said pipeline.

25. A method in accordance with claim 17 including the step of adjusting the temperature of said slurry at selected points along said pipeline.

26. A method in accordance with claim 17 wherein said step of slurrying said coal comprises pressurizing said finely divided coal with gaseous carbon dioxide and then mixing the resulting pressurized coal with liquid carbon dioxide.

27. A method in accordance with claim 26 including the step of returning at least a portion of said coal-free carbon dioxide from said coal use point to said coal source point.

28. A method in accordance with claim 27 wherein said step of returning said coal-free carbon dioxide to said coal source point comprises liquefying said coal-free carbon dioxide at said coal use point and pumping it through a separate liquid pipeline back to said coal source point for reuse in forming said slurry.

29. A method in accordance with claim 28 including the step of boosting the pressure of said liquid carbon dioxide at selected points along said liquid pipeline.

30. A method in accordance with claim 28 including the step of adjusting the temperature of said liquid carbon dioxide at selected points along said liquid pipeline.

31. A method for transporting coal from a coal source point to a coal use point, comprising the steps of (a) forming liquid carbon dioxide at said coal source point by burning coal in an excess of air to form combustion gases containing carbon dioxide, purifying said combustion gases to provide essentially pure carbon dioxide gas, and liquefying said carbon dioxide gas;

(b) forming with said liquid carbon dioxide a coal/liquid carbon dioxide slurry in which said coal is in finely divided particulate form having a size range between about 40$\mu$ and about 300$\mu$ and a size distribution optimized with respect to the viscosity of said liquid carbon dioxide to stabilize said slurry, and in which said coal makes up from about 60% to about 80% by total weight of said slurry; and (c) pumping said slurry through a pipeline to said coal use point.

32. A method in accordance with claim 31 including the step of deslurrying said coal/liquid carbon dioxide slurry at said coal use point to provide said coal in condition for burning and carbon dioxide essentially free of any coal or of any solidified carbon dioxide.

33. apparatus for transporting coal in finely divided form from a coal source point to a coal use point, comprising in combination (a) means at a coal source point to form liquid carbon dioxide comprising combustion means to burn coal thereby to form gaseous carbon dioxide; means to purify said gaseous carbon dioxide; and means to liquefy the purified gaseous carbon dioxide;

(b) slurry forming means at said coal source point to form a coal/liquid carbon dioxide slurry;

(c) deslurrying means at a coal use point to deslurry said coal/liquid carbon dioxide slurry to provide coal for combustion and essentially coal-free carbon dioxide; and (d) slurry pipeline means connecting said slurry forming means and said deslurrying means arranged to carry said coal/liquid carbon dioxide slurry under conditions of temperature and pressure to maintain essentially all of said carbon dioxide in liquid form.

34. Apparatus in accordance with claim 33 wherein said slurry forming means comprise, in combination (1) pressure vessel means adapted to contain coal in finely divided form;

(2) means to pressurize said pressure vessel means with gaseous carbon dioxide; and (3) means to slurry liquid carbon dioxide under pressure with said coal in said pressure vessel means.

35. Apparatus in accordance with claim 33 including booster pumping means associated with said slurry pipeline means to maintain the pressure of said liquid carbon dioxide at a predetermined level along the length of said slurry pipeline.

36. Apparatus in accordance with claim 33 including means associated with said slurry pipeline means to maintain the temperature of said liquid carbon dioxide at a predetermined level along the length of said slurry pipeline.

37. Apparatus in accordance with claim 33 wherein said deslurrying means comprise, in combination (1) means to reduce the pressure of said coal/liquid carbon dioxide slurry thereby to vaporize essentially all of said liquid carbon dioxide; and (2) means to supply heat during the reduction in slurry pressure sufficient to compensate for the sensible heat loss during said reduction in pressure and to prevent the formation of any appreciable quantity of solid carbon dioxide.

38. Apparatus in accordance with claim 37 wherein said means to supply heat during said reduction in slurry pressure comprises means to mix carbon dioxide at an elevated temperature with said slurry.

39. Apparatus in accordance with claim 33 including means at said coal use point for liquefying said coal-free carbon dioxide; and liquid pipeline means arranged to return the resulting liquefied carbon dioxide to said coal source point.

40. Apparatus in accordance with claim 39 including booster pumping means associated with said liquid pipeline means to maintain the pressure of said liquid carbon dioxide at a predetermined level along the length of said liquid pipeline.

41. Apparatus in accordance with claim 39 including means associated with said liquid pipeline means to maintain the temperature of said liquid carbon dioxide at a predetermined level along the length of said liquid pipeline.

* * * * *